United States Patent [19]

Takuma

[11] Patent Number: 4,810,948

[45] Date of Patent: Mar. 7, 1989

[54] CONSTANT-VOLTAGE REGULATED POWER SUPPLY CIRCUIT

[75] Inventor: Michio Takuma, Tsuchiura, Japan

[73] Assignee: Texas Instruments Incorporated, Dallas, Tex.

[21] Appl. No.: 114,889

[22] Filed: Oct. 29, 1987

[30] Foreign Application Priority Data

Oct. 31, 1986 [JP] Japan ..... 61-260000

[51] Int. Cl.[4] ..... G05F 1/56

[52] U.S. Cl. ..... 323/280; 323/281; 323/297; 323/353

[58] Field of Search ..... 323/273, 280, 281, 282, 323/283, 297, 298, 353, 354

[56] References Cited

U.S. PATENT DOCUMENTS 4,668,932 5/1987 Drori et al. ..... 323/354 X
4,689,550 8/1987 Ujihara et al. ..... 323/354
4,713,602 12/1987 Ueda ..... 323/354

OTHER PUBLICATIONS

"Programmable Regulator Card", A. J. Mumaw, IBM Technical Disclosure Bulletin, vol. 20, No. 6, Nov. 1977, p. 2180.

*Primary Examiner*—Peter S. Wong
*Assistant Examiner*—Emanuel T. Voeltz
*Attorney, Agent, or Firm*—Richard K. Robinson; Melvin Sharp; N. Rhys Merrett

[57] ABSTRACT

A constant-voltage regulated power supply circuit has an input circuit and an output circuit. The sense circuit includes a programmable sense circuit that further includes a divider network with a plurality of selectable tap points and a multiplexer having a plurality of inputs and an output with each tap point being connected to an individual input of the multiplexer. A controllable pass element is operatively connected in the power supply circuit between the input circuit and the output circuit. A comparator connected to receive inputs from a selected tap point and a reference voltage generating circuit provides an output to control the controllable pass element.

6 Claims, 1 Drawing Sheet

CONSTANT-VOLTAGE REGULATED POWER SUPPLY CIRCUIT

BACKGROUND OF THE INVENTION

1. Field of the Invention

The present invention relates to a constant-voltage regulated power supply circuit.

2. Description of the Prior Art

The conventional constant-voltage regulated power supply circuit is so designed to regulate an output voltage utilizing an output voltage divider comprising a variable resistor VR1, as shown in FIG. 1. However, the conventional circuit has several defects these include:

The requirement for plural variable resistors or high precision resistors.

Adjusting the output voltage requires user intervention therefore, the operation is inevitably complicated;

the output voltage sometimes fluctuates by mechanical stress such as vibration.

OBJECTS AND SUMMARY OF THE INVENTION

It is an object of the invention to provide a constant-voltage regulated power supply circuit which does not need any external parts for regulating an output voltage, which can simplify assembling process and regulation process, and which is free from a change of parameters with time.

Namely, the invention provides a constant-voltage regulated power supply circuit in which a data register is connected to the output side so as to control an output voltage.

Other objects, features and advantages of the invention will appear more fully from the following detailed description thereof taken in connection with the accompanying drawings.

DESCRIPTION OF THE PREFERRED EMBODIMENTS

Figure 1:
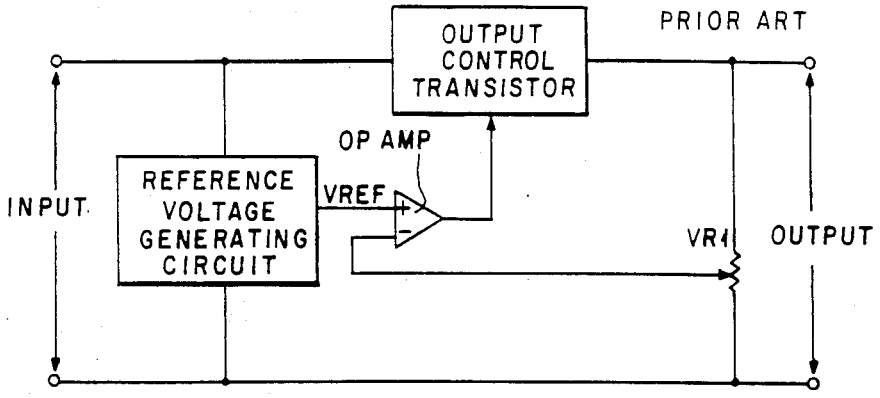
FIG. 1 is a block diagram of a constant-voltage regulated power supply circuit of the prior art.
Figure 2:
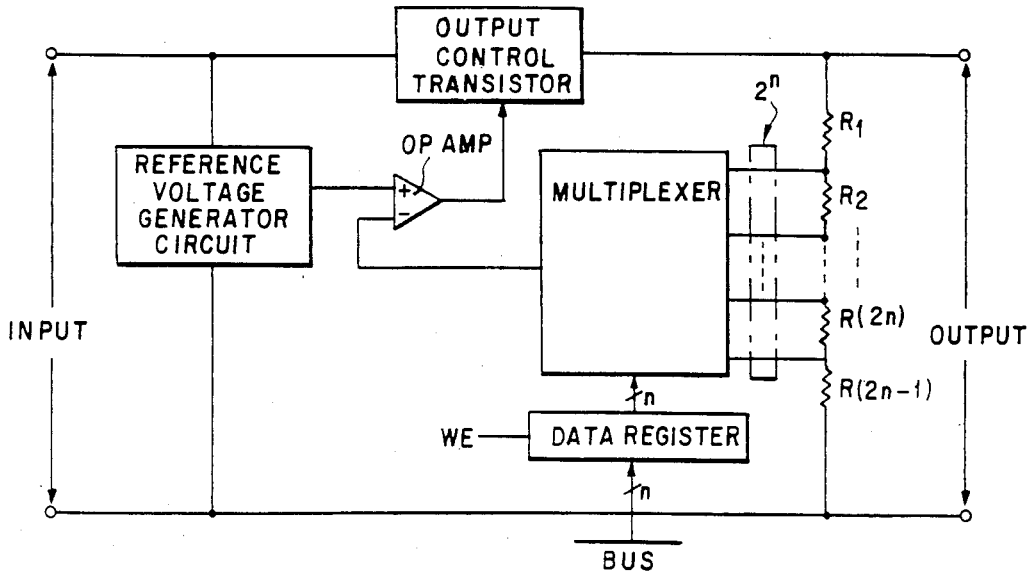
FIG. 2 is a block diagram of a constant-voltage regulated power supply circuit embodying the invention.

FIG. 2 is a block diagram of a constant-voltage regulated power supply circuit embodying the invention. In this circuit, an output voltage divider comprises a resistor which is divided into elements $R_1$ to $R(2^n+1)$ according to a current data length. These resistor elements are connected between two output terminals in series. Then, nodes (connecting points) of these resistor elements constituting a voltage divider are decoded through a multiplexer, one selected among the nodes acts as an input into a minus terminal of an operation amplifier (OP AMP). An address input of the multiplexer is supplied from an output of a data register that is connected to a data bus (BUS) controlled from a micro-computer (not shown).

By the above construction, it is possible to gain $2^n$ kinds of regulated output voltage when a bit length of the data register is n. Precision of the output voltage can be assured by positioning the resistances $R_1$ to $R(2^n+1)$ and the multiplexer in physically symmetrical layout.

It is also possible to make one step width of the output voltage variable by regulating resistance value per one voltage dividing resistance.

In the present example, because fine regulation of the output voltage is possible as described above, the output voltage can be made variable in the range of 1.5 V±200 mV. And, it is also possible to set an output level to 10 V by modifying the reference voltage. The power supply circuit of the example can be applied, to a power supply of a micro-computer with a built-in AD converter or a built-in DA converter.

The multiplexer is disposed between the output voltage divider circuit and the OP AMP and one selected circuit of the multiplexer is actuated by the address input from the data register. Accordingly, it is possible to regulate the output voltage simply and stably, and the regulation and assembling process is easy with no external parts. As a matter of course, the output voltage does not fluctuate by mechanical vibration etc.

It will be evident that various modifications can be made to the described embodiments without departing from the scope of the present invention.

In the invention, as described above, because the output voltage is regulated by the use of the data register, it is possible to regulate the output voltage simply and stably, and the regulation and assembling process is easy because of no use of any external parts.

What is claimed is:

1. A constant-voltage regulated power supply circuit comprising:

an input circuit;

an output circuit that includes dual output terminals, a programmable sense circuit connected across the dual output terminals and including a series voltage divider network having a plurality of selectable tap points, and a multiplexer having a plurality of inputs and an output with each tap point being connected to an individual input of the multiplexer;

a reference voltage generating circuit;

a controller pass element operatively connected in the power supply circuit between the input circuit and the output circuit; and a comparator connected to receive inputs from the output of the multiplexer and the reference voltage generating circuit and to provide an output to adjust the conductivity of the controllable pass element.

2. The constant-voltage regulated power supply according to claim 1 wherein the output circuit further comprises:

a data register operatively connected between a data bus and the multiplexer to provide data for selecting the tap point.

3. The constant-voltage regulated power supply according to claim 1 wherein the comparator comprises an operational amplifier.

4. A constant-voltage regulated power supply circuit comprising:

an input circuit means for receiving an unregulated input voltage;

an output circuit means for providing an regulated output voltage, the output circuit means including: dual terminals and a programmable means for setting the output voltage level of the power supply, the programmable means being connected across the dual terminals and including a series voltage divider network having a plurality of selectable tap points and a multiplexer having a plurality of inputs and an output, with each tap point connected to an individual input of the multiplexer;

a reference voltage source for generating a reference voltage;

a controllable pass element means for controllably conducting the input voltage from the input circuit means to the output circuit means; and a comparator means for comparing the reference voltage to the output of the multiplexer and to control the pass element means based on the results of the comparison.

5. The constant-voltage regulated power supply according to claim 4 wherein the output circuit means comprises:

a data register operatively connected between a data bus and the multiplexer for providing data for selecting the tap point.

6. The constant-voltage regulated power supply according to claim 4 wherein the comparator comprises an operational amplifier.

* * * * *